US006530502B2

(12) United States Patent
Neal

(10) Patent No.: US 6,530,502 B2
(45) Date of Patent: Mar. 11, 2003

(54) SELF-DRAINING DISHWASHING CADDY

(76) Inventor: Mylene Neal, 2453 Blackton Dr., San Diego, CA (US) 92105

( * ) Notice: Subject to any disclaimer, the term of this patent is extended or adjusted under 35 U.S.C. 154(b) by 87 days.

(21) Appl. No.: 09/746,938

(22) Filed: Dec. 21, 2000

(65) Prior Publication Data

US 2002/0079333 A1 Jun. 27, 2002

(51) Int. Cl.[7] ..... B67D 1/07
(52) U.S. Cl. ..... 222/192; 222/108; 222/135
(58) Field of Search ..... 222/192, 181.3, 222/385, 135, 321.9, 108; D6/525, 542, 551

(56) References Cited

U.S. PATENT DOCUMENTS

| | | | | |
|---|---|---|---|---|
| 3,228,737 A | | 1/1966 | Kipnis | |
| 3,920,164 A | * | 11/1975 | Lindsoe | 222/385 |
| 4,934,640 A | | 6/1990 | Bichon | |
| 5,014,860 A | | 5/1991 | Emery | |
| 5,156,450 A | | 10/1992 | Lee | |
| 5,238,106 A | | 8/1993 | Nguyen et al. | |
| D341,973 S | * | 12/1993 | Gerstmar | D6/542 |
| D351,042 S | * | 9/1994 | Sulezich | D6/525 |
| 5,413,251 A | * | 5/1995 | Adamson | 222/181.3 |
| 5,690,255 A | * | 11/1997 | White | 222/192 |
| 5,865,325 A | | 2/1999 | Comstock | |
| D414,362 S | | 9/1999 | Olmos | |
| D416,728 S | | 11/1999 | Kelso et al. | |

* cited by examiner

*Primary Examiner*—Philippe Derakshani
(74) *Attorney, Agent, or Firm*—Gene Scott-Patent Law & Venture Group

(57) ABSTRACT

A dishwashing caddy is constructed with internal volumes for holding soap liquid and lotion as well as compartments for storing cleaning brushes and the like. The top surface is strongly slanted forward and the bottom internal partition is also slanted forward to dispense water through weep holes. Pump action dispensing of the liquids is accomplished. Suction cups mount the unit to a wall or hold it in place while on the sink or other support.

7 Claims, 3 Drawing Sheets

SELF-DRAINING DISHWASHING CADDY

BACKGROUND OF THE INVENTION

1. Field of the Invention

This invention relates generally to implement storage devices and more particularly to an apparatus for holding and storing implements and materials for cleaning pots, pans, cooking utensils serving ware, cooking ware, and dinner ware.

2. Description of Related Art

The following art defines the present state of this field:

Olmos, U.S. Pat. No. D414,362 describes an organizing unit.

Kelso et al., U.S. Pat. No. D416,728 describes a shower basket with shelf.

Kipnis, U.S. Pat. No. 3,228,737 teaches a toilet rack of unitary construction comprising a rear wall, a front wall, at least a pair of shelves attached substantially perpendicular to said rear wall, an intermediate divider between said pair of shelves and substantially parallel to said rear wall, at least one divider between said pair of shelves substantially perpendicular to said rear wall, said intermediate divider, said shelves and said divider forming a plurality of compartments accessible from the sides and adapted to receive toilet articles, said front wall having attached thereto substantially horizontal indentation means having outward extension and adapted to receive toothbrushes and a substantially horizontal perforated tab adapted to receive a safety razor, and means to mount said rack on a wall.

Bichon, U.S. Pat. No. 4,934,640 teaches a portable soap container comprising a dish portion with a hinged fastenable lid. On one side wall of the dish portion is mounted three suction cups which allow the side wall to be fastened to a vertical wall for example of a shower. A bracket member is pivotally mounted on the underside of the container and moveable from a stored position in which it lies alongside the undersurface of the container to an operating position in which it depends downwardly from the undersurface to define a contact portion which engages the wall beneath the suction cups to prevent the weight of the container twisting the suction cups off the wall.

Emery, U.S. Pat. No. 5,014,860 teaches a bath caddy mountable by means of suction cups on a non-porous surface which is positionally adjustable in four directions and has a frame including a horizontal element, a plurality of members attached perpendicularly thereto and a horizontal bar attached thereto and a horizontal bar attached to such members having each end open to receive slidably mounted suction cups.

Lee, U.S. Pat. No. 5,156,450 teaches a portable soap caddy assembly with a toiletry receptacle having an opening and a sidewall for holding various toiletries and having means for mounting the receptacle to a vertical wall with opening facing upwardly. This assembly provides an auxiliary receptacle with an opening and sidewalls and a mounting assembly for movably mounting the auxiliary receptacle to the toiletry receptacle between a first open position where the sidewall of the toiletry receptacle closes the opening of the auxiliary receptacle and a second position where the auxiliary opening is opened facing upwardly. A further assembly has an auxiliary receptacle with an opening, sidewall and bottom and means for mounting the auxiliary receptacle to the toilety receptacle to close the opening of the toiletry receptacle. In addition, means for partitioning the auxiliary receptacle opening from the toiletry receptacle opening is provided and means for holding the auxiliary receptacle against the sidewall of the toiletry receptacle with the auxiliary opening facing upwardly. Finally another assembly has a releasable attachment mechanism to mount the portable soap caddy assembly and means for mounting the releasable attachment mechanism between a wall mounting position in which the mechanism is in position to releasably attaching toiletry receptacle to the wall and a storage position in which the mechanism is releasably secured to the sidewall of the toiletry receptacle.

Nguyen et al., U.S. Pat. No. 5,238,106 teaches an organizer consisting of two main parts, a base and a lid. The base is sectioned into compartments by a divider. One compartment is used for storing sponges, and the other is used for storing sponges or cleaning tools with handle or combination of both. The slots on the sides of the base accommodate those tools with handle. There are drainage holes on the bottom of the base which allow liquid to drain out. There are also suction cups on the outside of the bottom of the base to keep it in place. The lid of the organizer, when opened, serves as a reservoir to hold washing solution. When closed, the lid hides the unsightly cleaning tools.

Comstock, U.S. Pat. No. 5,865,325 teaches a dish cloth dryer rack including a wire-like frame having a dish-cloth drying portion thereof, which drying portion is curved to fit over a sink divider. The rack is held in place by feet which support the rack above the level of the sink divider, thereby providing a free air space between the rack and the sink divider. A tool-carrying basket may be integrally formed with the elongate portion to provide storage for soap and additional cleaning tools.

The prior art teaches the use of supports and containers for holding cleaning implements but does not teach a container for holding a variety of cleaning implements and solutions which is able to self drain on both the interior and exterior surfaces. The present invention fulfills these needs and provides further related advantages as described in the following summary.

SUMMARY OF THE INVENTION

The present invention teaches certain benefits in construction and use which give rise to the objectives described below.

A dishwashing caddy is constructed with internal volumes for holding soap liquid and lotion as well as compartments for storing cleaning brushes and the like. The top surface is strongly slanted forward and the bottom internal partition is also slanted forward to dispense water through weep holes. Pump action dispensing of the liquids is accomplished. Suction cups mount the unit to a wall or hold it in place while on the sink or other support.

A primary objective of the present invention is to provide an apparatus and method of use of such apparatus that provides advantages not taught by the prior art.

Another objective is to provide such an invention capable of self-draining of water or other liquids.

A further objective is to provide such an invention capable of suction mounting to a wall.

A still further objective is to provide such an invention capable of holding cleaning implements in self-draining compartments and holding plural liquids such as soap and lotion.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
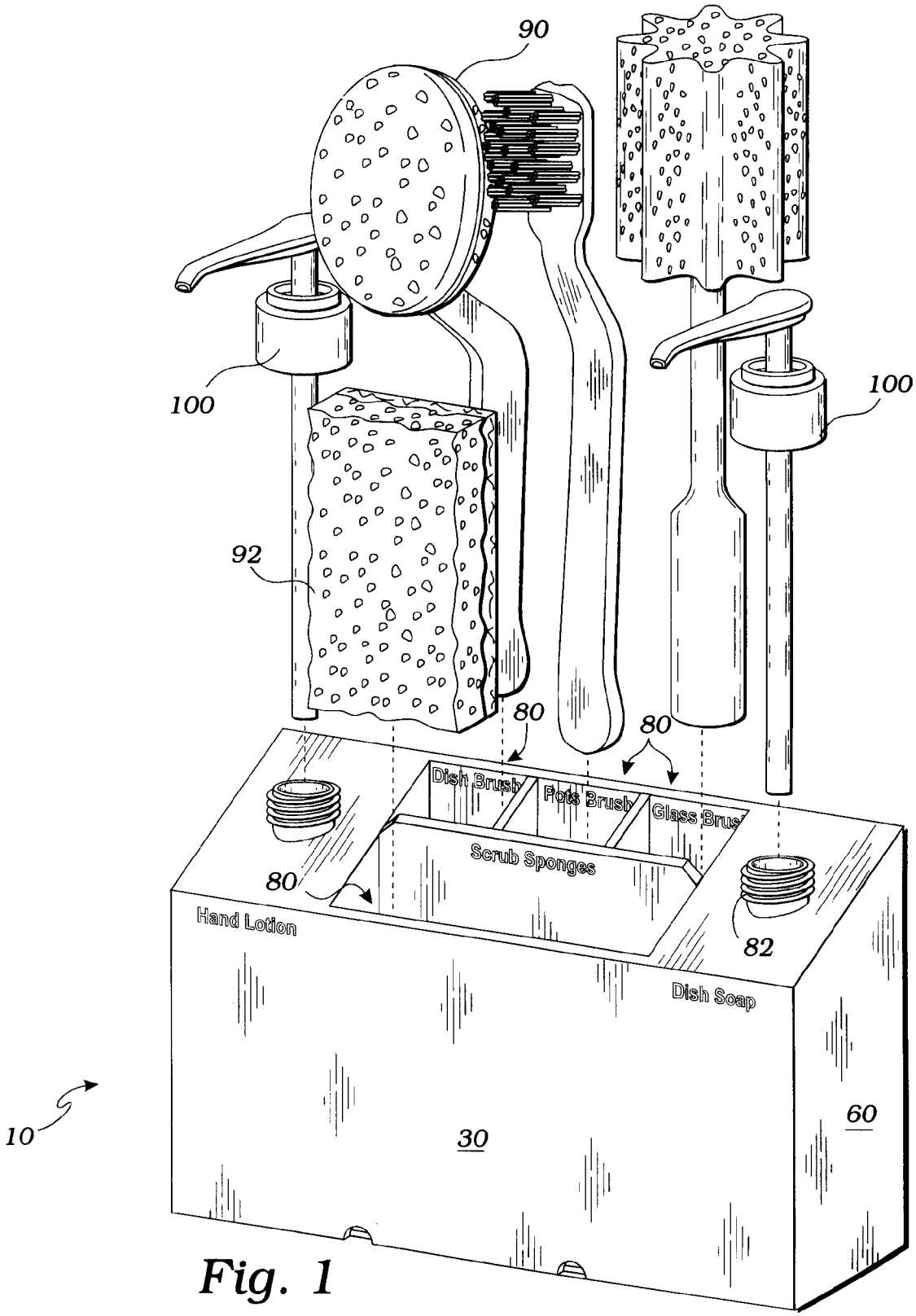
FIG. 1 is an exploded view of the preferred embodiment of the invention.

A container apparatus 10 comprises a bottom panel 20, a front panel 30, a back panel 40, a top panel 50, and a pair of spaced apart side panels 60; the panels forming a parallelepiped structure defining an enclosed volume 70, preferably separated into at least two volume portions as clearly shown in the figures. This container structure is preferably made of injection molded plastic or assembled from plastic sheet stock welded along joined edges as is very well known in the field. The top panel 50 lies in a plane sloped at a downward angle, preferably 45 degrees, from the back panel 40 to the front panel 30. This sloped top panel 50 provides for advantageous liquid runoff forwardly so as to be self draining of water that drips from the various cleaning implements. Preferably, the top panel 50 provides plural apertures 80 adapted for receiving at least one cleaning implement 90 and at least one suction device 100, for instance a hand pump dispenser as seen in FIG. 1, for drawing fluid 110 from the enclosed volume 70.

Figure 2:
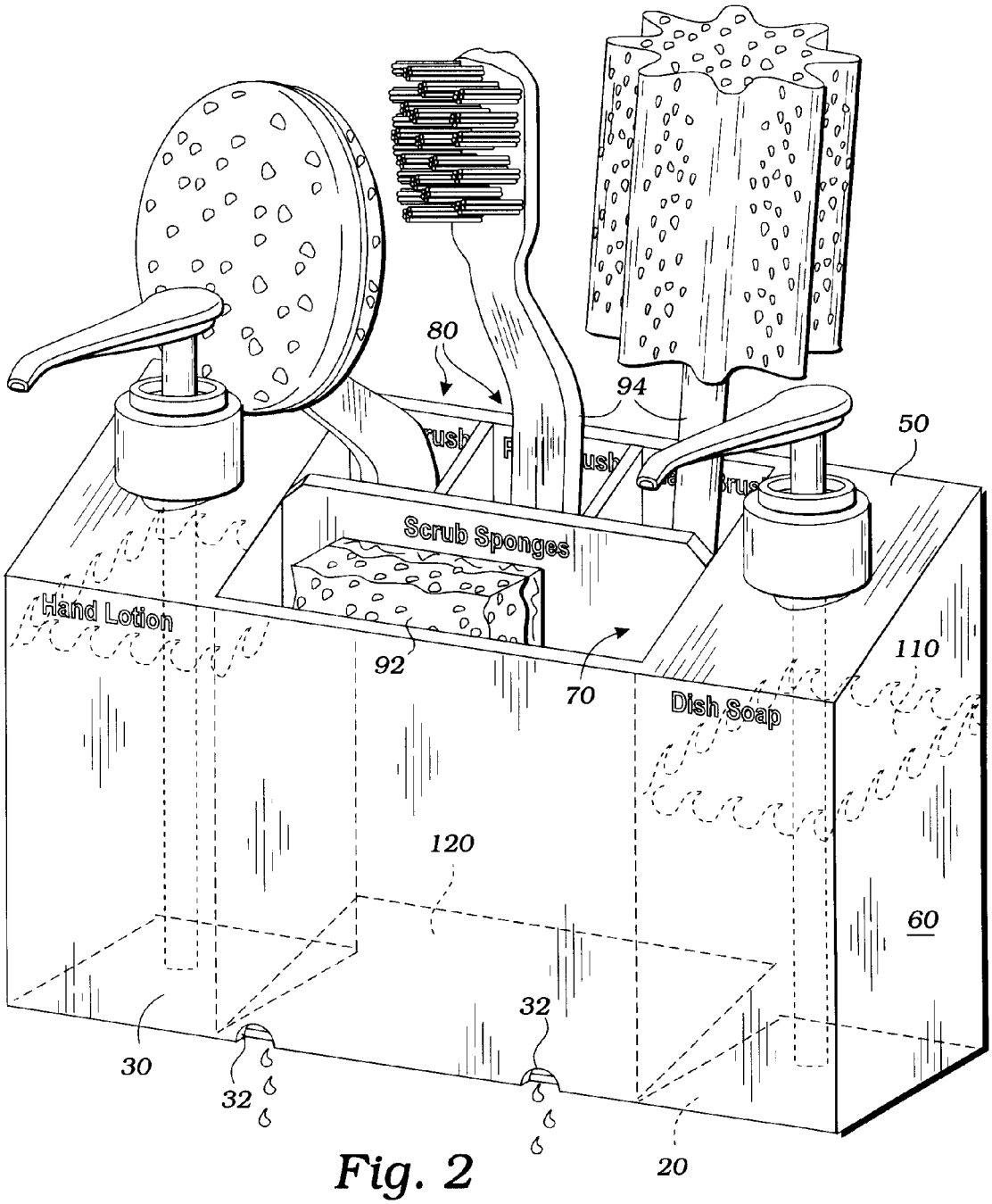
FIG. 2 is a perspective view thereof.
Figure 3:
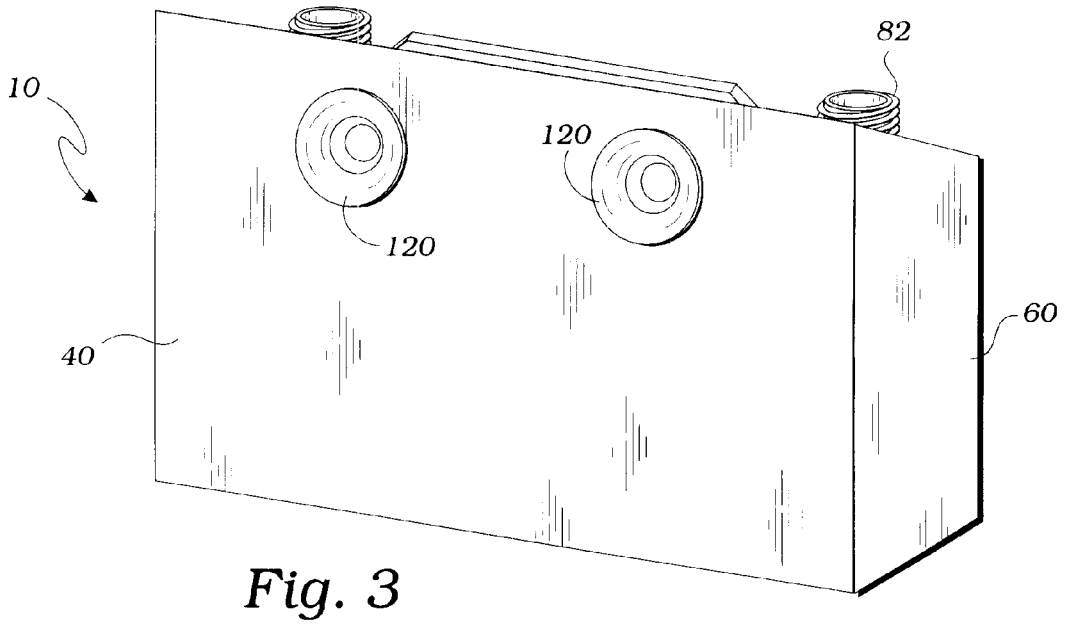
FIG. 3 is a rear perspective view thereof.
Figure 4:
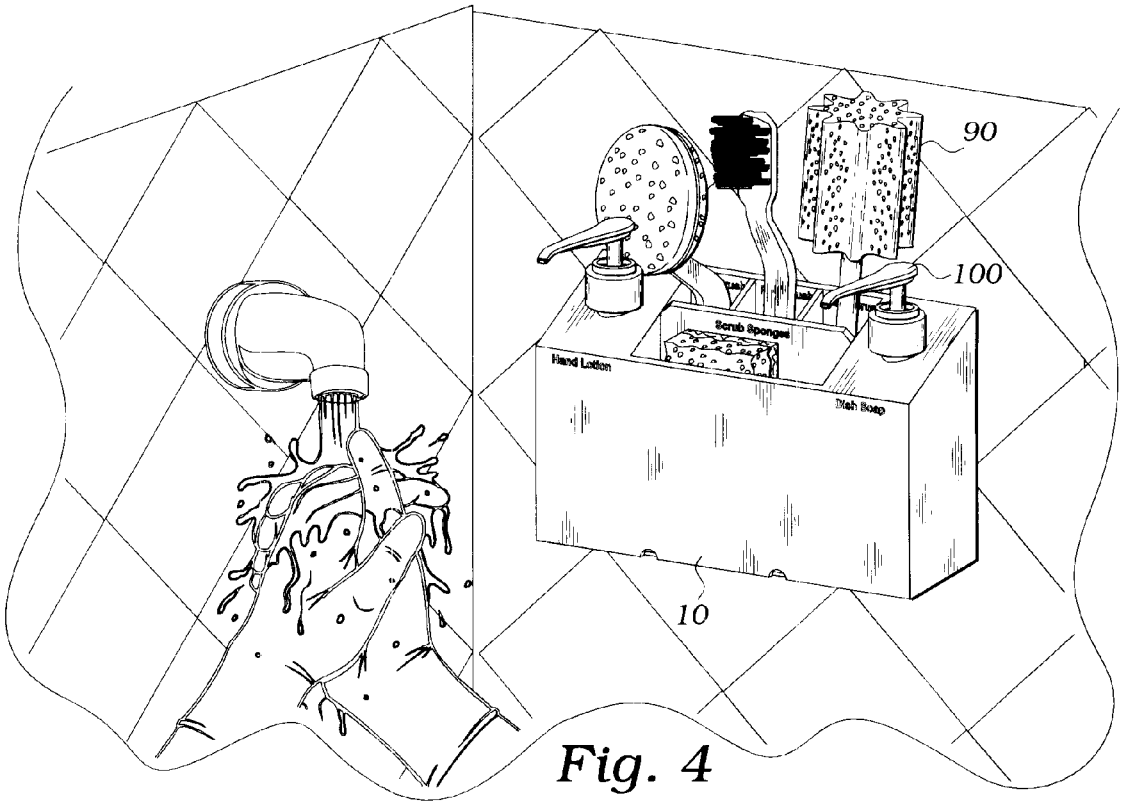
FIG. 4 is a perspective view thereof showing the invention suction-mounted to a wall.

As best shown in FIG. 3, a surface suction adhesion device 120 such as one or more suction cups is mounted integrally on the back panel 40 for removably affixing the apparatus 10 to a wall or similar surface, as shown in FIG. 4. The wall, etc. is not a part of the instant invention. As shown in FIG. 2, at least one of the plural apertures 80 is sized for receiving a sponge 92 and the other apertures are sized for receiving handles 94 of a scrub brush and a variety of other brushes and implements normally used for cleaning dishes and such.

Clearly, the present invention may also be considered, not as the simple container apparatus 10 taken alone, but in combination with the implements 90 and fluids 110 that are used with it as well. Such a combination apparatus comprises the container apparatus 10 as described above, plus the plurality of cleaning implements 90 adapted for being received in the plural apertures 80 and at least one cleaning fluid 110 adapted by its viscosity for being pumped from the enclosed volume 70 and at least one suction device 100 engaged with at least one of the plural apertures 80, as for instance, the external screw threaded lip 82 shown in FIG. 1.

The apparatus further advantageously provides an internal partition 120 adjacent to the bottom panel 20, and positioned for receiving liquid runoff from the sponge 92 and the scrub brush 90 and other implements, the internal partition 120 is positioned by having a draft angle for directing liquid runoff toward drip apertures 32 in the front panel 30.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A container apparatus comprising a bottom panel, a front panel, a back panel, a top panel, and a pair of spaced apart side panels; the panels forming a parallelepiped structure defining an enclosed volume within; the top panel lying in a plane sloped at a downward angle from the back panel to the front panel and providing therethrough, plural apertures adapted for receiving at least one cleaning implement and at least one suction device for drawing fluid from the enclosed volume and further providing an internal partition adjacent the bottom panel, the internal partition positioned for receiving liquid runoff from the at least one cleaning implement in at least one of the plural apertures, the internal partition sloped for directing said liquid runoff to drip apertures in the front panel, whereby the liquid runoff is directed forward of the apparatus.

2. The apparatus of claim 1 wherein the enclosed volume comprises at least two separated volume portions.

3. The apparatus of claim 1 further comprising a surface suction adhesion device integral with the back panel for removably affixing the apparatus to a wall.

4. The apparatus of claim 1 wherein the downward angle is approximately 45 angular degrees.

5. The apparatus of claim 1 wherein at least one of the plural apertures is sized for receiving a sponge.

6. The apparatus of claim 5 wherein at least one of the plural apertures is sized for receiving a handle of a scrub brush.

7. The apparatus of claim 1 wherein the at least one suction device is a hand pump dispenser.

* * * * *